US006247419B1

(12) United States Patent
Tajima et al.

(10) Patent No.: US 6,247,419 B1
(45) Date of Patent: Jun. 19, 2001

(54) MULTINEEDLE EMBROIDERING SEWING MACHINE

(75) Inventors: Ikuo Tajima; Isao Ohashi, both of Kasugai (JP)

(73) Assignee: Tokai Kogyo Mishin Kabushiki Kaisha, Aichi (JP)

( * ) Notice: Subject to any disclaimer, the term of this patent is extended or adjusted under 35 U.S.C. 154(b) by 0 days.

(21) Appl. No.: 09/372,962

(22) Filed: Aug. 12, 1999

(30) Foreign Application Priority Data

Aug. 19, 1998 (JP) ..... 10-233097
Jan. 11, 1999 (JP) ..... 11-004318
Apr. 30, 1999 (JP) ..... 11-125077

(51) Int. Cl.[7] ..... D05B 1/08; D05B 49/00; D05C 11/08

(52) U.S. Cl. ..... 112/98; 112/241; 112/163

(58) Field of Search ..... 112/98, 241, 246, 112/248, 242, 244, 254, 255, 163, 167, 155

(56) References Cited

U.S. PATENT DOCUMENTS 2,670,704 * 3/1954 Backlin ..... 112/248
3,783,811 * 1/1974 Schmedding et al. ..... 112/241
4,444,138 * 4/1984 Yamazawa ..... 112/241
5,983,818 * 11/1999 Tramutolo et al. ..... 112/241

* cited by examiner

*Primary Examiner*—Peter Nerbun
(74) *Attorney, Agent, or Firm*—Koda & Androlia

(57) ABSTRACT

A multineedle embroidering sewing machine comprising at least one sewing machine head provided with a plurality of needle bars and a plurality of thread take-up levers corresponding to the needle bars, needle thread deflecting sections, respectively, arranged upstream of the respective thread take-up levers existing in needle thread paths, and thread take-up members provided correspondingly on the respective needle thread deflecting sections.

7 Claims, 20 Drawing Sheets

MULTINEEDLE EMBROIDERING SEWING MACHINE

BACKGROUND OF THE INVENTION

1. Field of the Invention

This invention relates to a multineedle embroidering sewing machine including sewing machine heads, each provided with a plurality of needle bars and a plurality of thread take-up levers corresponding to the needle bars, and more particularly, to a sewing machine, in which needle thread paths in the vicinity of thread take-up levers are improved.

2. Description of the Related Art

With a sewing machine, in which the vertical motion of a needle cooperates with a rotating hook to perform lock stitch, a descending needle pierces an article being sewn to reach a bottom dead point, and a tip end of the rotating hook catches a needle thread at a timing, at which the needle ascends again. With the subsequent rotation of the rotating hook, the needle gets through the rotating hook to pass through an engagement between a rotating hook bobbin case holder and a hook support to thereby join a bobbin thread received in the rotating hook bobbin case holder, so that the needle thread and the bobbin thread form a stitch. In this forming of a stitch, the needle thread is required to have suitable loosening and drawing-up, which are given by a thread take-up, but a rapid change in tension acting on the needle thread cannot be followed only by the thread take-up. Hereupon, a thread take-up member (which is formed from a torsion spring and so called a "thread take-up spring") is provided for accommodating a rapid change in tension on the needle thread. Such thread take-up member is arranged immediately adjacent an upstream area of the thread take-up positioned in a path of the needle thread in common sewing machines for industrial use and for home use.

Thereupon, with a lock stitch type multineedle embroidering sewing machine including sewing machine heads, each provided with a plurality of needle bars, the above-mentioned thread take-up member is arranged upstream of a tension thread guard because there is a limitation in a space for arrangement. However, the tension thread guard is arranged further upstream of a needle thread deflecting section provided upstream of the thread take-up positioned in a path of the needle thread. Accordingly, the path for feeding of the needle thread is necessarily curved many times between the thread take-up and the thread take-up member. Therefore, the needle thread becomes great in contact resistance at such curved portions to decrease a reaction related to a thread take-up motion of the thread take-up member, with the result that the thread take-up member does not fulfill its primary function adequately, thus causing thread breakage disadvantageously.

SUMMARY OF THE INVENTION

This invention has been proposed to suitably solve drawbacks involved in the prior art in view of these, and has its object to provide a multineedle embroidering sewing machine, which is improved so as to be capable of having thread take-up members fulfilling their primary function and dissolves a difficulty, in a threading operation, newly caused by the improvement.

To overcome the above-mentioned problems and to effectively attain the expected object, this invention provides a multineedle embroidering sewing machine including at least one sewing machine head provided with a plurality of needle bars and a plurality of thread take-up levers corresponding to the needle bars, the sewing machine further comprising needle thread deflecting sections, respectively, arranged upstream of the respective thread take-up levers existing in needle thread paths, and thread take-up members provided correspondingly on the respective needle thread deflecting sections.

DESCRIPTION OF THE PREFERRED EMBODIMENTS (First Invention)

Figure 1:
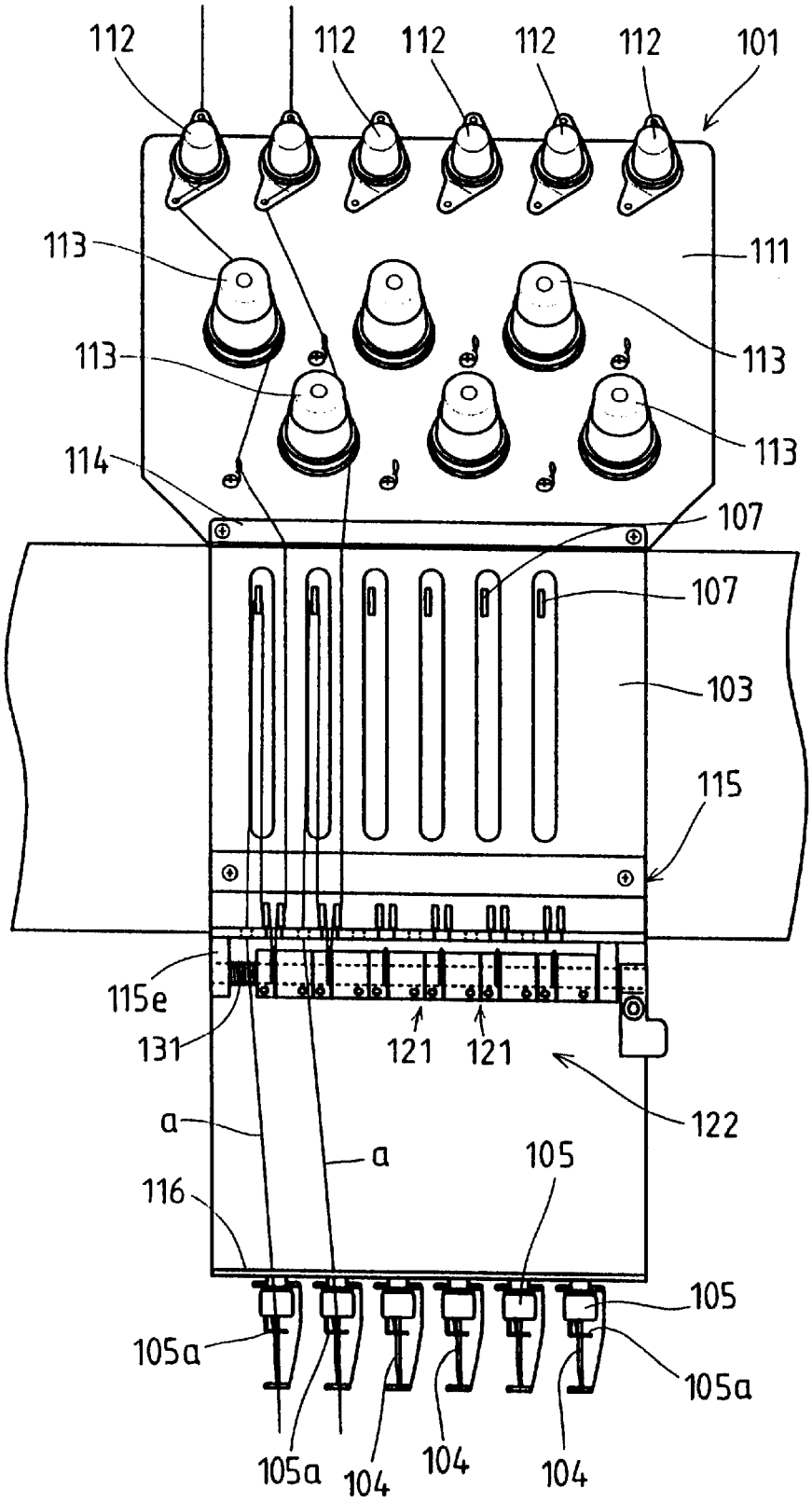
FIG. 1 is a front view showing a sewing machine head in a multihead multineedle embroidering sewing machine according to an embodiment of a first invention.

A preferred embodiment of a first invention will be described hereinafter by way of a multihead multineedle embroidering sewing machine provided with a plurality of multineedle heads, with reference to the accompanying drawings. For example, FIG. 1 is a front view showing one of a plurality of sewing machine heads 101 in the multihead multineedle embroidering sewing machine. The plurality of sewing machine heads 101 are supported on respective sewing machine arms 102 (see FIG. 2), which are correspondingly provided on a front face of a lengthy sewing machine (not shown) extending laterally, through support casings 103 to be slidable laterally. A plurality of needle bars 105 (six in the embodiment) are supported on the support casing 103 to be vertically movable, and thread take-up levers 107 (six in the embodiment) are swingably supported on the support casing 103 correspondingly to these needle bars 105. Further, the support casings 103 are made by a drive device (not shown) to slide laterally, whereby one needle bar 105 and one thread take-up lever 107 are interlinked with a drive mechanism housed in the sewing machine arms 102 to be driven thereby.

An adjustable base 111 is fixed to a top of the support casing 103 in inclined position, and first stitch balancing thread tension members 112, which correspond to the respective needle bars 105 (the thread take-up levers 107), and second stitch balancing thread tension members 113 are mounted to a front face of the adjustable base 111. The respective stitch balancing thread tension members are well known, and the first stitch balancing thread tension members 112 comprise two tension discs biased by a spring to abut elastically against each other, the elasticity of the spring being adjusted to enable changing a pressing force. Also, the second stitch balancing thread tension members 113 are constructed such that a rotary disc, on an outer periphery of which a thread is wound, is pressed by a spring and the elasticity of the spring is adjusted to enable changing a rotating resistance of the rotary disc.

Figure 2:
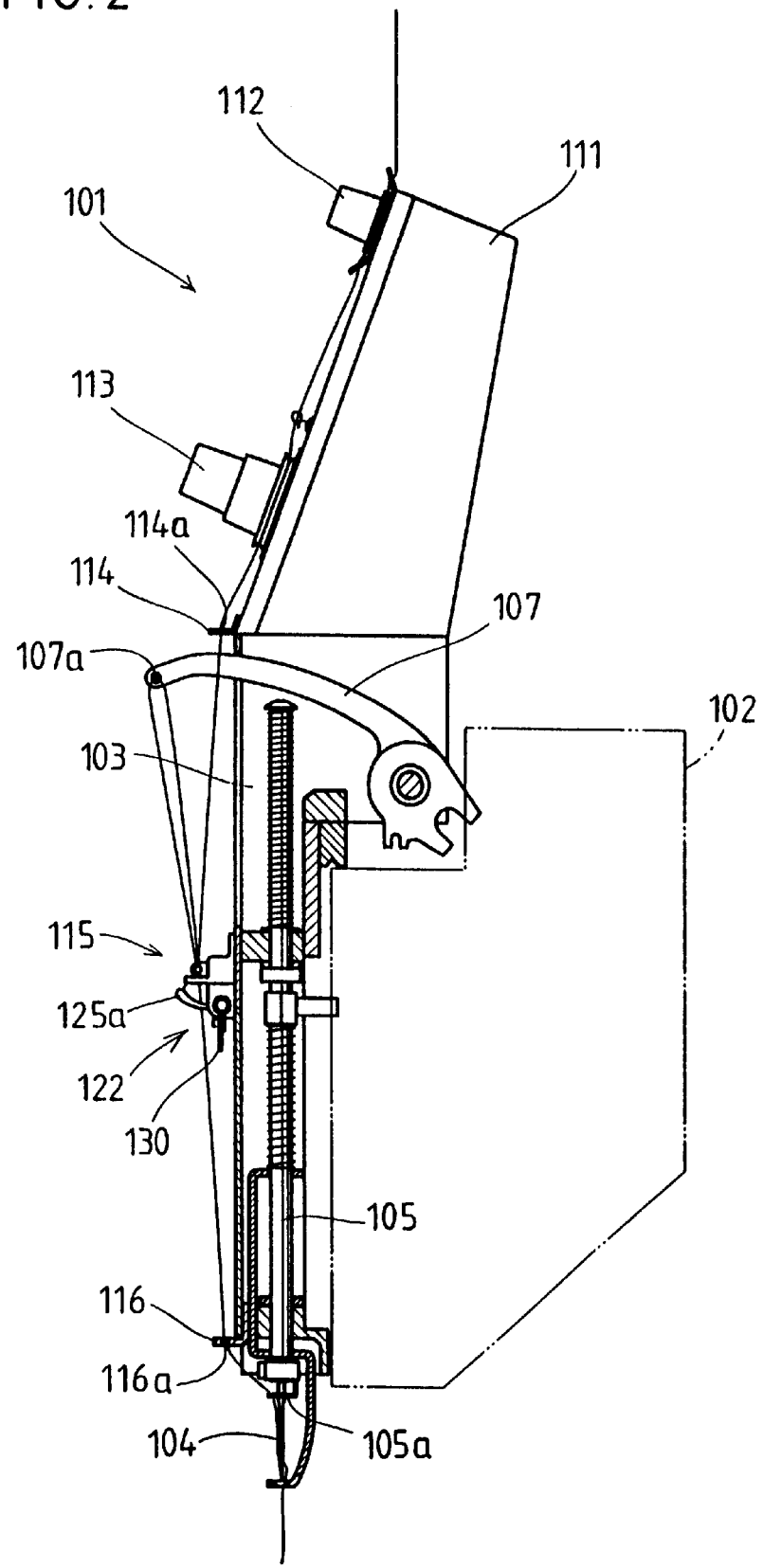
FIG. 2 is a right-side view showing the sewing machine head shown in FIG. 1.
Figure 3:
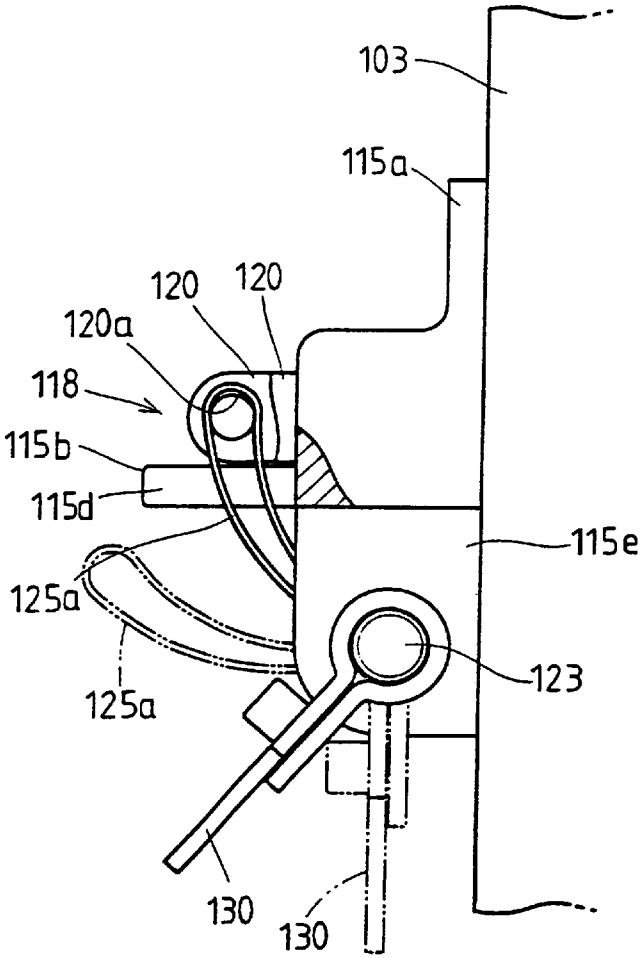
FIGS. 3(*a*) and 3(*b*) are side views showing a positional relationship between a middle thread handling area and a thread take-up assembly, according to a preferred embodiment.
Figure 3:
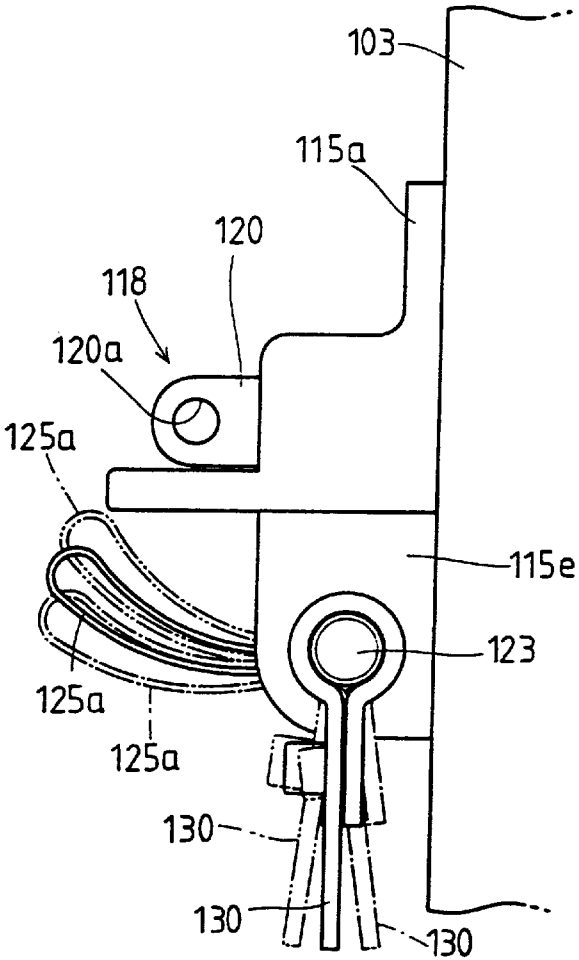
Figure 4:
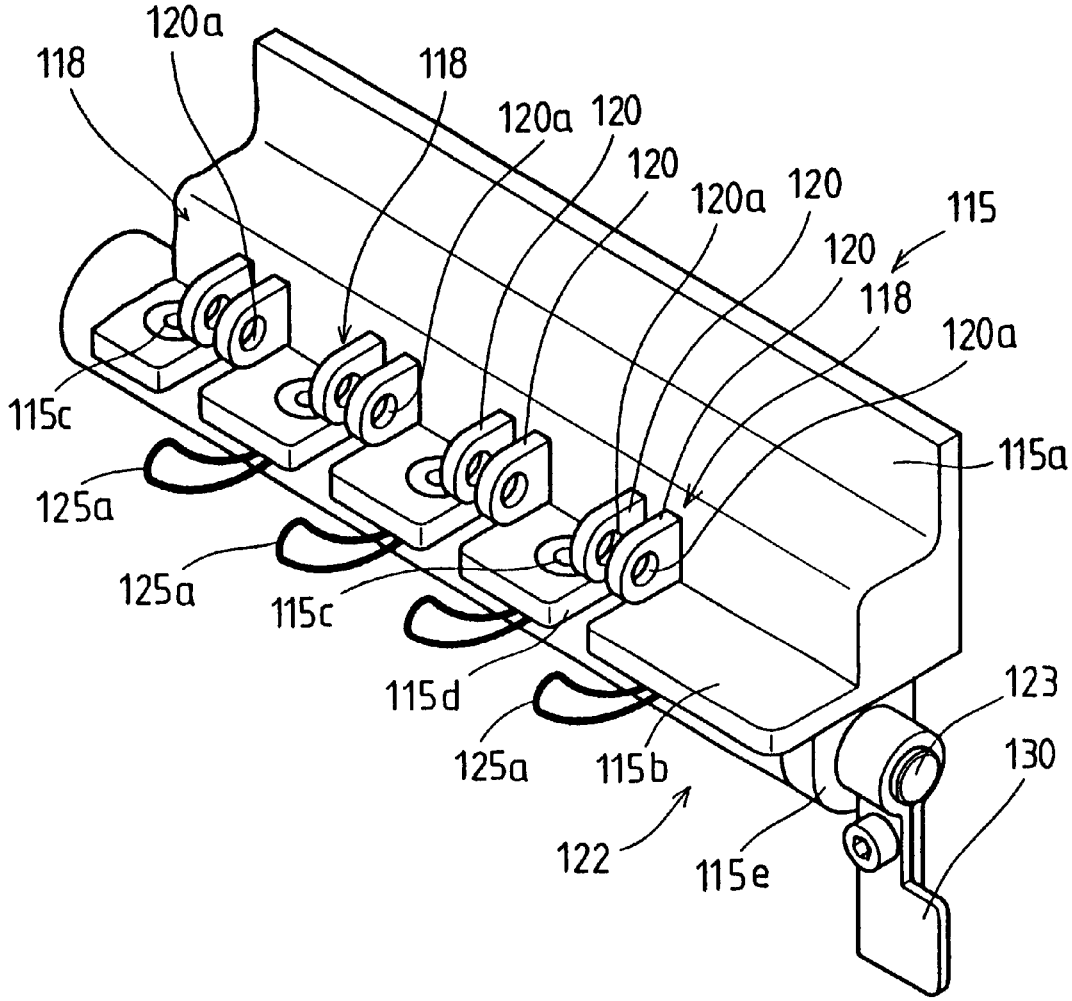
FIG. 4 is a fragmentary, perspective view showing the middle thread handling area and the thread take-up assembly shown in FIG. 3.

As shown in FIG. 2, a needle thread handling area 114 and a bobbin thread handling area 116 are correspondingly provided on upper and lower end edges of the support casing 103, and are formed with thread holes 114*a*, 116*a* (six for each), which correspond to the respective needle bars 105. A middle thread handling area 115 is arranged below a middle between the needle thread handling area 114 and the bobbin thread handling area 116. The middle thread handling area 115 comprises, as shown in FIGS. 3(*a*) and 3(*b*), a vertical section 115*a* secured to a front face of the support casing 103 and a horizontal section 115*b* formed integral therewith to extend horizontally, the horizontal section 115*b* being formed with thread holes 115*c* and slits 115*d*, which correspond to the respective thread take-up levers 107. As shown in FIG. 4, needle thread deflecting sections 118 are arranged above the respective slits 115*d*, and comprise two thread handling area bodies 120, 120 having thread holes 120*a*. These thread handling area bodies 120, 120 are provided with a predetermined gap, which bridges the slit 115*d*.

Figure 5:
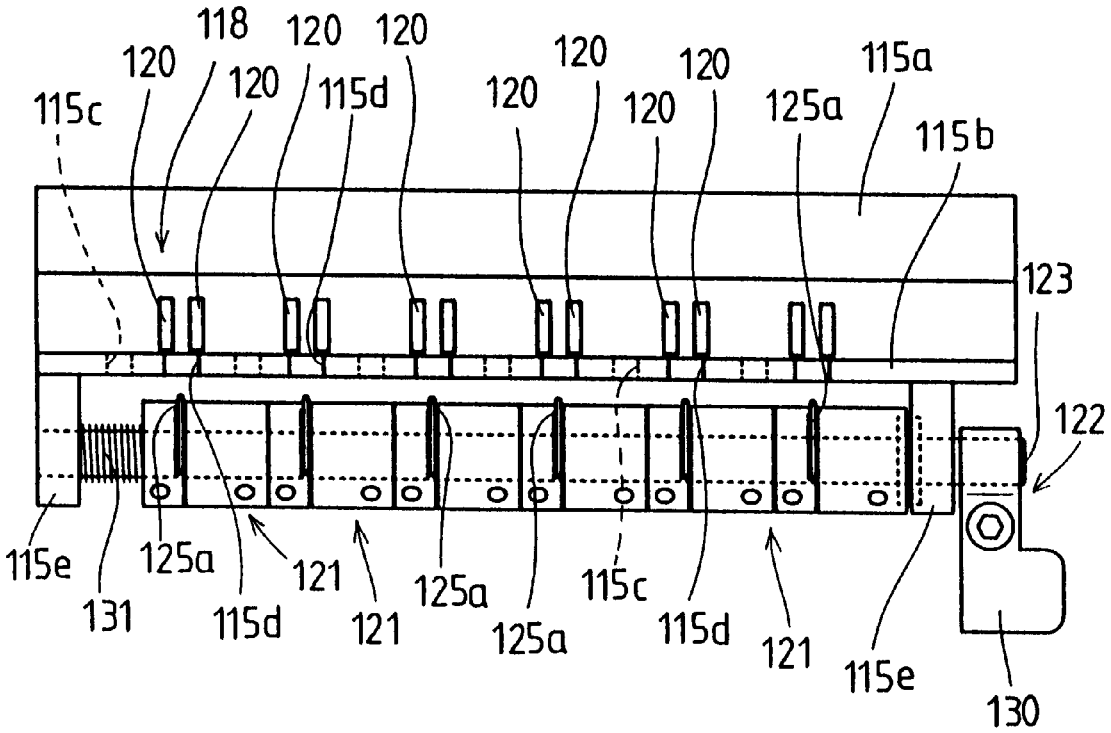
FIG. 5 is a front view showing the middle thread handling area and the thread take-up assembly shown in FIG. 4.

A thread take-up assembly 122 is arranged below the horizontal section 115*b* on the middle thread handling area 115, as shown in FIGS. 4 and 5. The thread take-up assembly 122 sets thread take-up units 121 which are the same in number as the thread take-up levers 107 (the needle bars 105) and correspond to the respective thread take-up levers 107. The thread take-up assembly 122 comprises, as shown in FIG. 5, a support shaft 123, which is supported between support plates 115*e*, 115*e* suspended from both ends of the horizontal section 115*b* to be rotatable and axially slidable, and the six thread take-up units 121 mounted on the support shaft 123.

Figure 6:
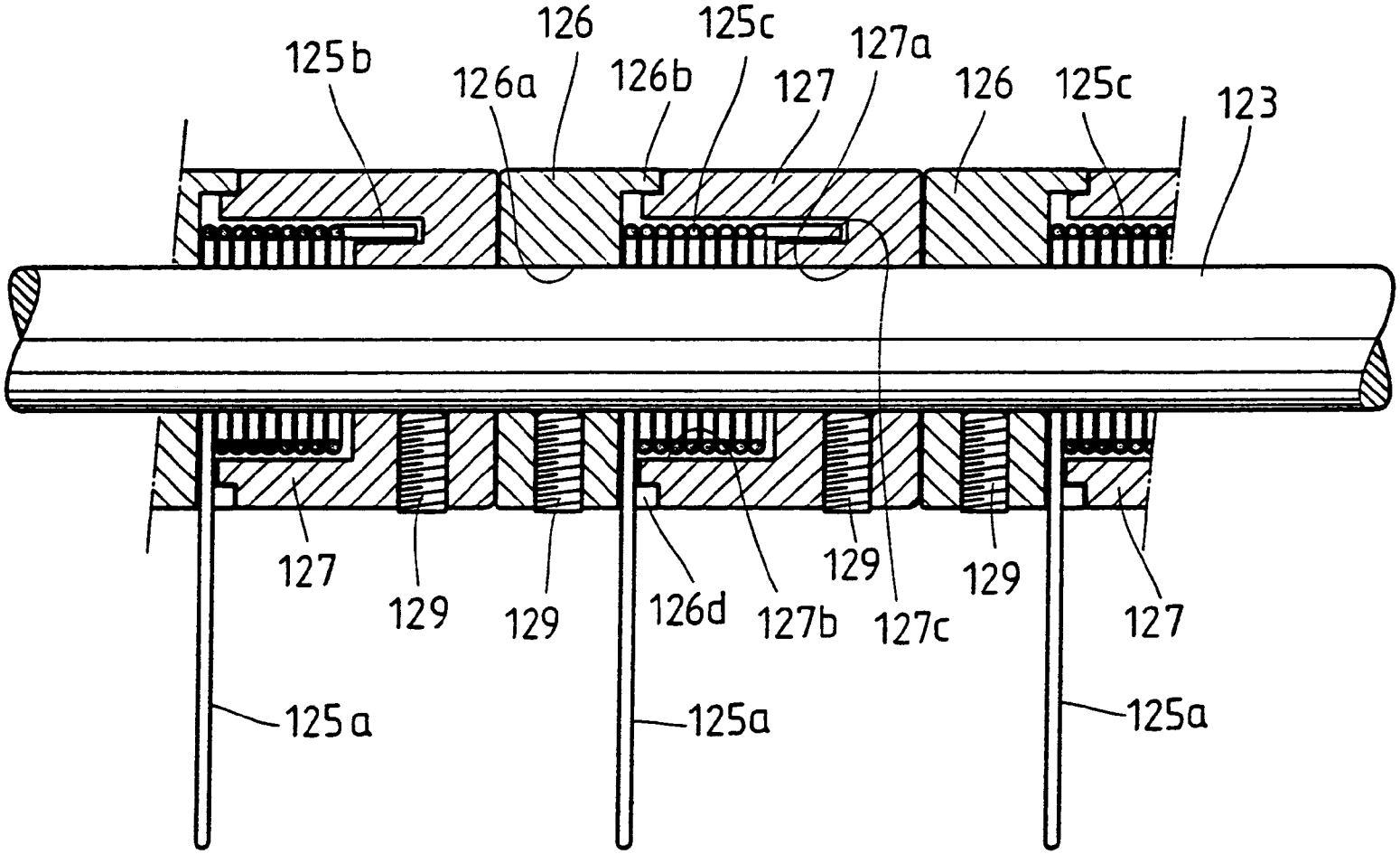
FIG. 6 is a fragmentary, enlarged cross-sectional view showing the thread take-up assembly, into which a thread take-up member, a stopper member and a spring tension adjusting member are assembled.
Figure 7:
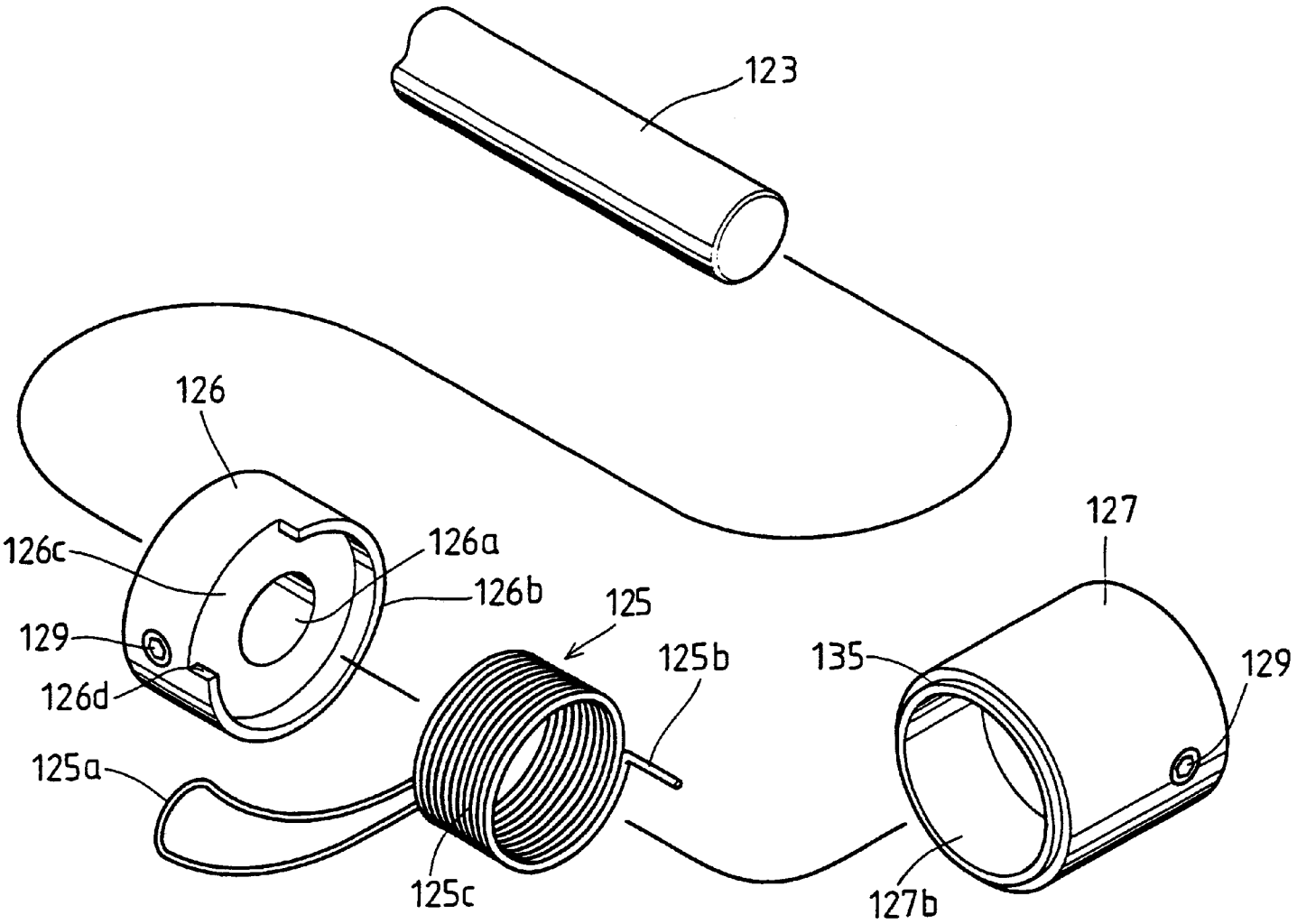
FIG. 7 is an exploded, perspective view showing a thread take-up unit according to a preferred embodiment.

The respective thread take-up units 121 essentially comprise a thread take-up member 125, which comprises a spirally wound spring steel wire, a stopper member 126 and a spring tension adjusting member 127, as shown in detail in FIGS. 6 and 7. The thread take-up member 125 comprises an arm portion 125*a* formed at one end of a spirally wound portion 125*c* in closed loop and extending radially, and a latch portion 125*b* formed by projecting the other end of the spirally wound portion 125*c* in an axial direction. Further, the spring tension adjusting member 127 is formed as a cylindrical-shaped member, and comprises a central hole 127*a* (FIG. 6) adapted to fit rotatably onto the support shaft 123, a mount hole 127*b* (FIG. 7), into which the spirally wound portion 125*c* of the thread take-up member 125 is loosely fitted, and a latch hole 127*c* (FIG. 6), into which the latch portion 125*b* of the thread take-up member 125 is fitted. The stopper member 126 comprises a central hole 126*a* adapted to fit rotatably onto the support shaft 123, and an annular-shaped wall 126*b*, onto which a reduced diameter stepped portion 135 formed on an outer periphery of an opening edge of the mount hole 127*b* on the spring tension adjusting member 127 is fitted, the annular-shaped wall 126*b* being formed over a required central angle with a notch 126*c*.

FIG. 6 is a cross-sectional view showing a state, in which the thread take-up member 125, the stopper member 126 and the spring tension adjusting member 127 shown in FIG. 7 are assembled. Thus, the spirally wound portion 125*c* of the thread take-up member 125 is inserted axially into the mount hole 127*b* on the spring tension adjusting member 127 with the latch portion 125*b* thereof mounted in latch hole 127*c* formed in the spring tension adjusting member 127. Further, when the annular-shaped wall 126*b* on the stopper member 126 is fitted onto the reduced diameter stepped portion 135 on the spring tension adjusting member 127, a semi-arcuate gap is defined between the notch 126*c* on the stopper member 126 and an end face of the spring tension adjusting member 127, from which gap the arm portion 125*a* on the thread take-up member 125 protrudes. In addition, the stopper member 126 and the spring tension adjusting member 127 are secured to the support shaft 123 by fastening a screw 129 inserted into a threaded hole formed on a peripheral side surface of the spring tension adjusting member 127.

Figure 8:
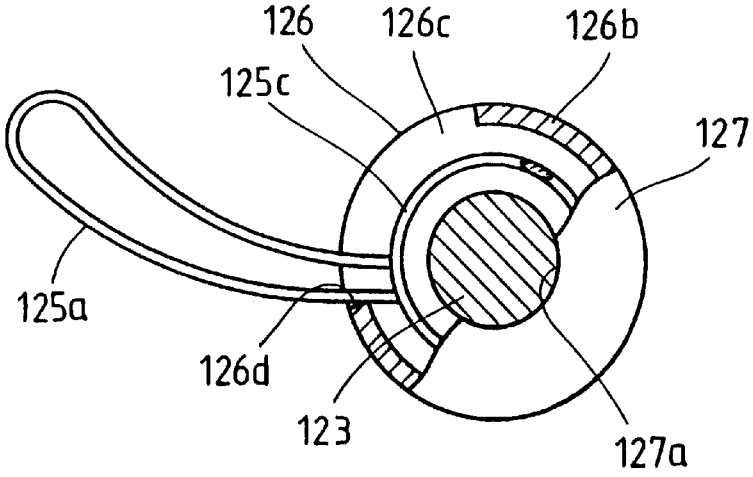
FIG. 8 is a longitudinal, cross-sectional view showing the thread take-up unit shown in FIG. 6.

As shown in FIG. 8, the spring tension of the thread take-up member 125 can be set optionally depending upon an angle, by which the spring tension adjusting member 127 is further rotated after the spring tension adjusting member 127 is rotated in a counterclockwise direction to cause a root portion of the arm portion 125*a* on the thread take-up member 125 to abut against a stopper portion 126*d* formed on the notch 126*c* on the stopper member 126. Also, the arm portions 125*a* on the respective thread take-up members 125 are aligned in the same position by putting angular positions of the respective stopper members 126 in the same order (see FIG. 4). Further, the arm portions 125*a* on the thread take-up members 125 in the respective thread take-up units 121 are set correspondingly immediately below the respective needle thread deflecting sections 118, that is, immediately below the respective slits 115*d*, as shown in FIG. 5, by mounting the respective thread take-up units 121 closely on the support shaft 123.

Figure 11:
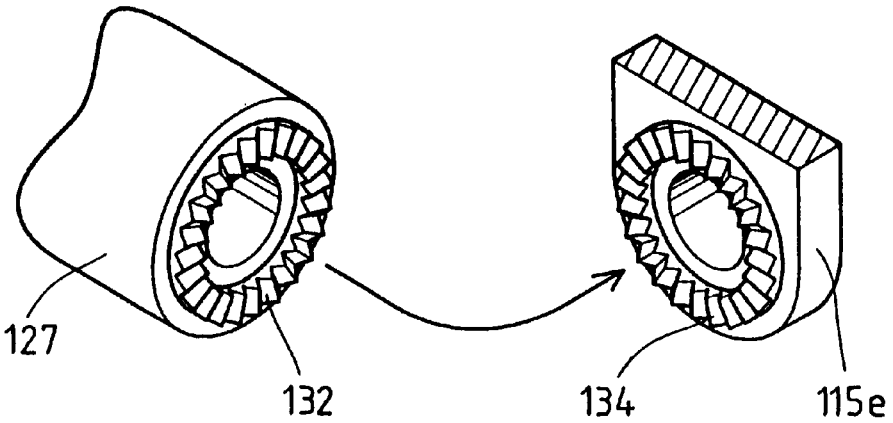
FIG. 11 is a perspective view showing a clutch mechanism incorporated into the thread take-up assembly.

The support shaft 123, onto which the thread take-up assembly 122 is fitted, is rotatable and axially slidable between the support plates 115*e*, 115*e* as described above, and a lever 130 is secured to an end of the support shaft extending from the righthand support plate 115*e*. Also, as shown in FIG. 5, a compression spring 131 is elastically provided on the support shaft 123 between the lefthand support plate 115*e* and the leftmost thread take-up unit 121, and permits its elastic force thereof to bias the rightmost thread take-up unit 121 axially rightward to abut against the support plate 115*e*. In this state, the lever 130 is separated from the support plate 115*e* as shown in FIG. 5. In addition, as shown in FIG. 11, clutch portions 132, 134 adapted to engage with each other at the time of engagement are formed on a right end surface of the spring tension adjusting member 127 on the thread take-up unit 121 disposed in the rightmost position and on a left end surface of the support plate 115*e* positioned rightward. The both clutch portions 132, 134 mesh with each other under the influence of the elastic tension of the compression spring 131 at all times to restrict free rotation of the support shaft 123. Only turning of the lever 130 results in movements of the clutch portions 132, 134 pitch by pitch, and subsequent up-and-down operation of the lever 130 can rotate the support shaft 123.

Figure 9:
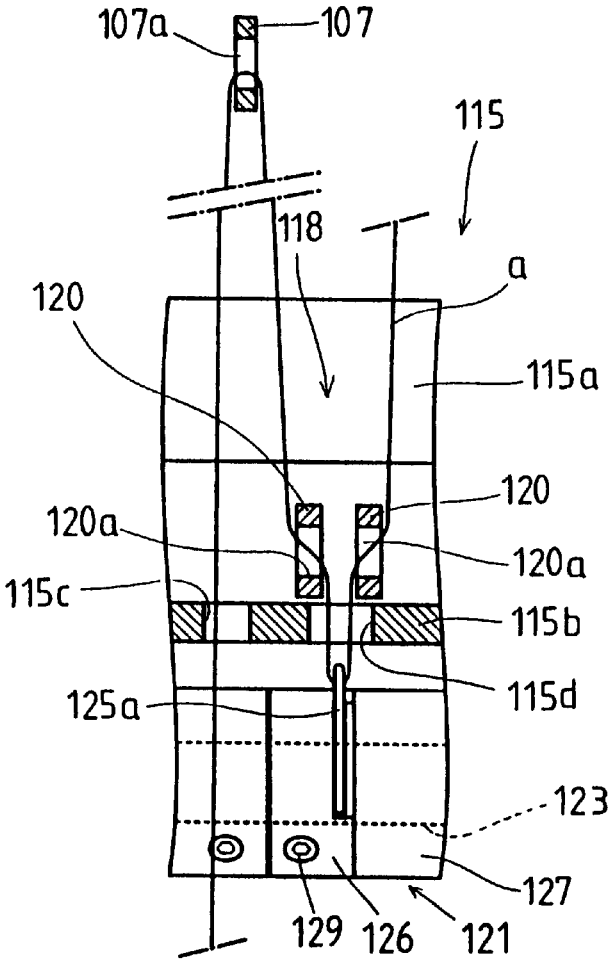
FIG. 9 is a fragmentary, front view showing a threading state on a middle thread handling area section according to a preferred embodiment.

The operation of the multihead multineedle embroidering sewing machine according to the embodiment of the first invention will be described hereinafter. A length of needle thread a unwound from a thread bobbin (not shown) set at a position upwardly of and backwardly of the sewing machine heads 101 is fed to an upper portion of the adjustable base 111 via a predetermined thread guide. The needle thread a is passed, as shown in FIG. 1, through the first stitch balancing thread tension member 112 and the second stitch balancing thread tension member 113 on the adjustable base 111, the thread hole 114*a* in the needle thread handling area 114, the middle thread handling area 115, a thread hole 7*a* in the thread take-up lever 107 and the thread holes 116*a* in the bobbin thread handling area 116 in this order, and then is passed through the eye of a needle 4 via a thread guard 5*a* on the needle bar 105. A manner of passing the needle thread a to the middle thread handling area 115 is further described, and thus after being passed through the thread hole 120*a* on the right thread handling area body 120, which constitutes the needle thread deflecting section 118 as shown in FIG. 9, the needle thread a is passed through the arm portion 125*a* on the thread take-up unit 121 and then is passed through the thread hole 120*a* on the left thread handling area body 120.

Figure 10:
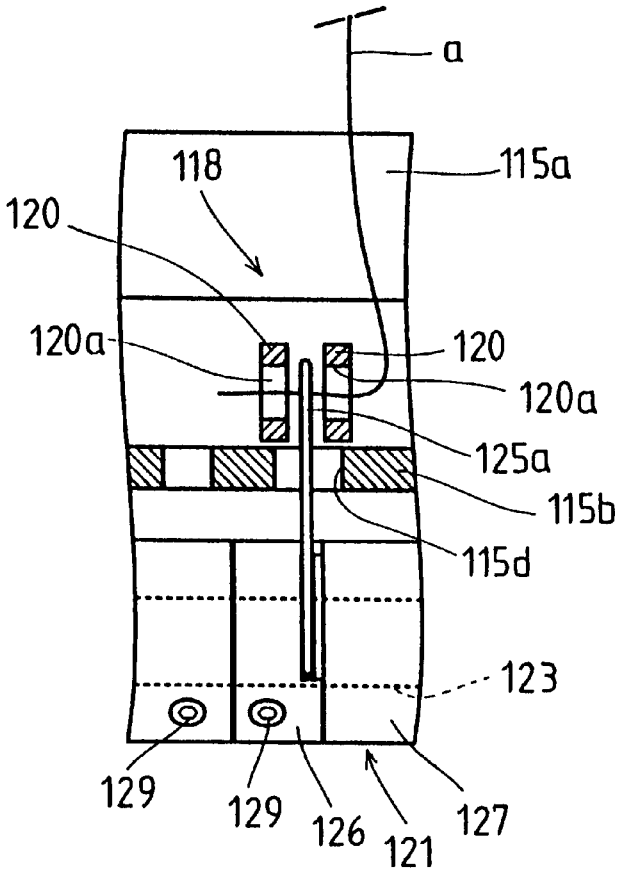
FIG. 10 is a fragmentary, front view showing an operating condition for the threading on a middle thread handling area section according to a preferred embodiment.

When a threading operation in the middle thread handling area 115 is to be performed, the support shaft 123 is rotated by pulling the lever 130 toward an operator to make tip ends of the arm portions 125*a* align with the thread holes 120*a* on the handling area bodies 120 as shown with solid lines in FIG. 3. Hereupon, the thread holes 120*a* on the handling area bodies 120 on both sides and the tip ends of the arm portions 125*a* are made to align in a row, so that the needle thread a can be simply passed from rightward, as shown in FIG. 10. After completion of the threading operation in this area, the lever 130 is returned to the original position as shown with imaginary lines in FIG. 3(*a*), and hence the arm portions 125*a* on the respective thread take-up members 125 are returned to their normal positions. In this manner, the one-touch operation of the lever 130 enables readily and rapidly performing the threading operation in an area on the middle thread handling area 115 and manipulation of the lever 130 enables making the arm portions 125*a* on the respective thread take-up members 125 all together in positions, at which threading is made possible, so that the arrangement is especially effective in the case of, for example, performing threading on the six needle bars 105 initially.

Also, at the time of the operation of the sewing machine, every time the needle bar 105 selected reciprocates, the arm portion 125*a* on the thread take-up member 125 actuates to reciprocate between positions shown with imaginary lines and solid lines in FIG. 3(*b*). At this time, a bent portion of the needle thread a existing between the thread take-up lever 107 and the arm portion 125*a* is positioned only at the left handling area body 120, which constitutes the needle thread deflecting section 118, and so the bending resistance on the needle thread a acts only at this portion. Accordingly, the arm portion 125*a* on the thread take-up member 125 sharply reacts on that change in tension of the needle thread a, which generates downstream of the thread take-up lever 107. Therefore, generation of thread breakage caused by late reaction of a thread take-up member as in the case of prior art apparatuses can be effectively avoided.

Further, in this embodiment, the operation of the lever 130 to suitably change a position of the arm portions 125*a* on the thread take-up members 125 in free condition as shown with dashed lines and two-dot chain lines in FIG. 3(*a*) can vary strokes of the arm portions 125*a* all together, so that a countermeasure in one-touch operation can be taken depending upon a kind of thread, stitch performance and a desired stitching. Because the compression spring 131 causes the clutch portions 132, 134 to mesh elastically with each other when turning the lever 130, there is produced an advantage that the meshing pitch causes positive movements of the support shaft 123 to make turning operation of the lever 130 easy, and sets up a standard of a turning angle to provide an ample sense of operation. However, such mechanism is not essential but may be a support construction, in which a predetermined magnitude of resistance is applied when the support shaft 123 is to be turned.

Further, as described above, the spring tension of each of the thread take-up members 125 can be individually adjusted by each of the thread take-up units 121, so that different adjustment of the thread take-up levers can be made by each of the needle bars 105 to take a suitable countermeasure depending upon the kind of needle thread used. Also, with the respective thread take-up units 121, thread breakage of the needle thread a or the like may be detected by providing an electrode on the stopper portion 126*d* for the arm portion 125*a* on the thread take-up member 125 and electrically detecting a condition of the electrode contacting with the arm portion 125*a*. Further, a pointer and a graduation, which indicate a turning angle of the lever 130 on the thread take-up assembly 122 may be provided so as to enable confirming the turning angle of the lever 130 or the support shaft 123 with a single glance.

(Second Invention)

Figure 12:
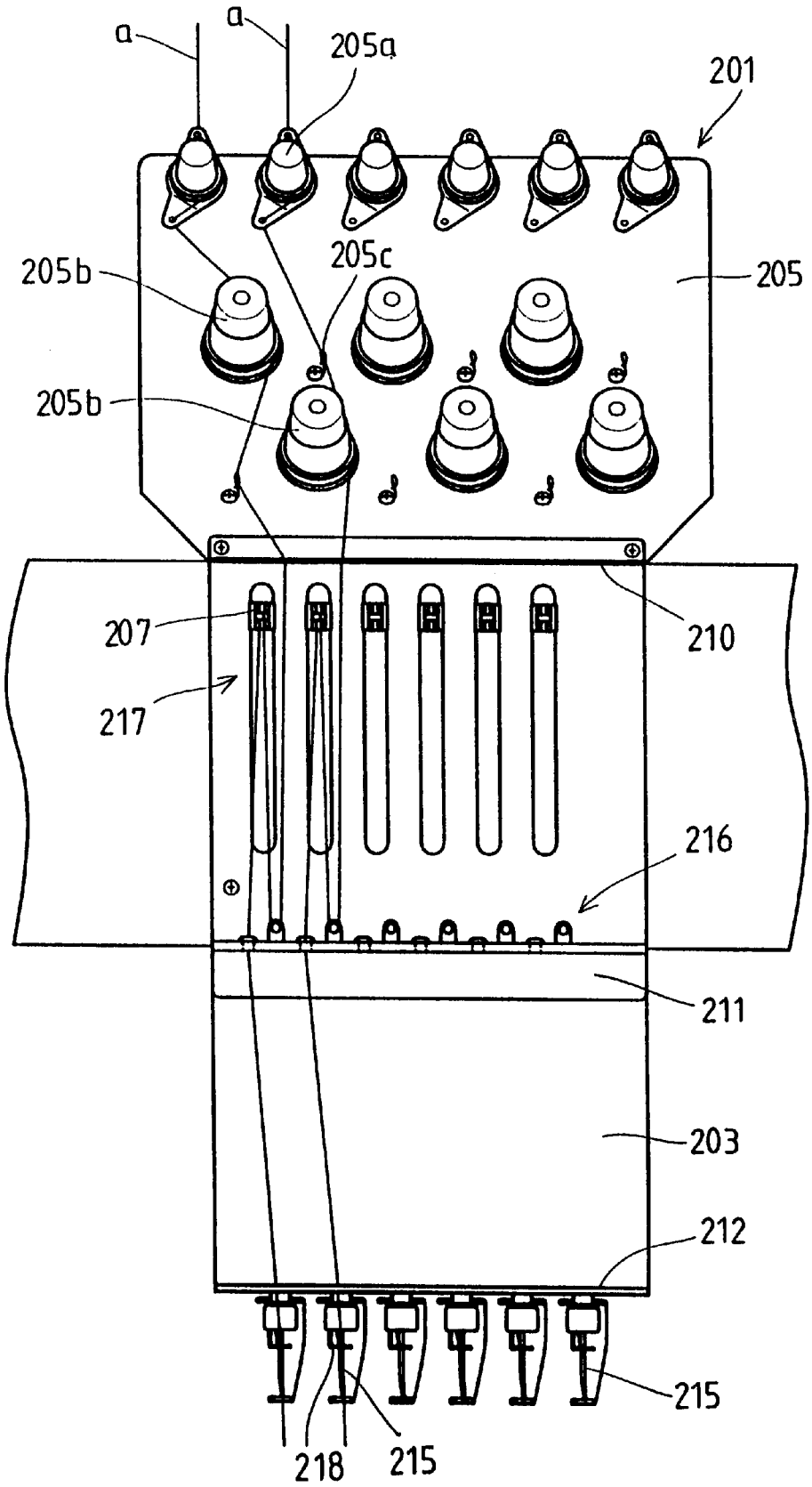
FIG. 12 is a front view showing a sewing machine head provided in a sewing machine according to a preferred embodiment of a second invention.
Figure 13:
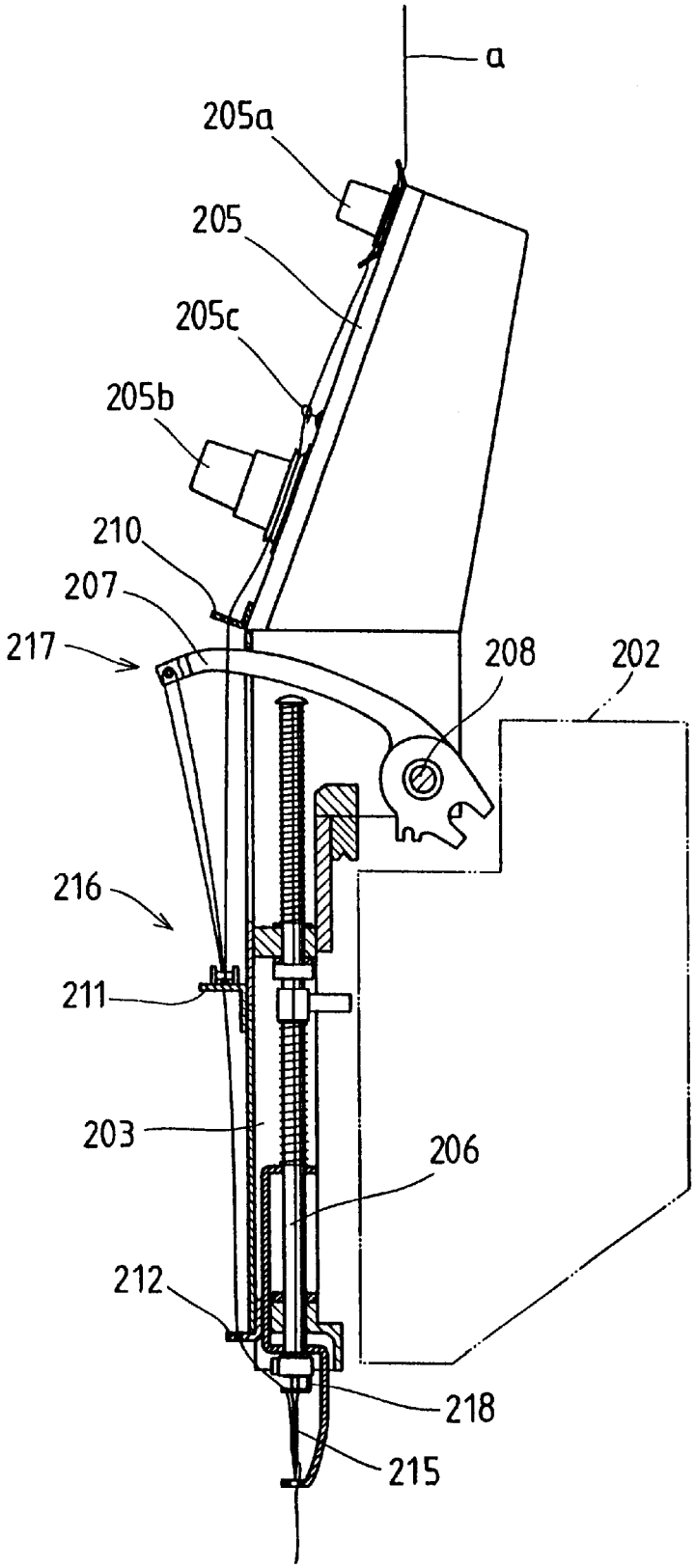
FIG. 13 is a longitudinal, cross-sectional view showing the sewing machine head shown in FIG. 12.

Subsequently, a sewing machine according to a second invention will be described. FIG. 12 is a front view showing one of a multiplicity of sewing machine heads 201 provided on a multihead multineedle embroidering sewing machine according to an embodiment of the invention, and FIG. 13 is a longitudinal cross-sectional view. The sewing machine head 201 comprises a sewing machine arm 202 fixed horizontally on a front face of a sewing machine frame (not shown) and a support casing 203 supported on a front face of the sewing machine arm 202 to be slidable laterally. Mounted obliquely on a top edge of the support casing 203 is an adjustable base 205 provided with a regulator.

A plurality of needle bars 206 (six in the embodiment) are supported on the support casing 203 to be positioned at a predetermined interval along a direction of sliding, and a plurality of thread take-up levers 207 (six in the embodiment) are supported on the support casing correspondingly to the respective needle bars 206. As shown in FIG. 13, the respective thread take-up levers 207 are supported at base ends thereof on a support shaft 208, disposed horizontally along a direction of sliding of the support casing 203, to be capable of vertically swinging over a required central angle.

A needle thread path disposed in the vicinity of the thread take-up lever 207 is defined in the following manner. As shown in FIGS. 12 and 13, a needle thread a supplied from a needle thread supply source (not shown) is guided to a needle 215 mounted to a lower end of the needle bar 206 via a regulator and a thread guard provided on the adjustable base 205, and via a needle thread handling area body 210, a middle thread handling area body 211 and a bobbin thread handling area body 212, which are stepwisely provided at predetermined spacings on a front face of the support casing 203. The needle thread a is passed, as specifically shown in FIG. 12, through a first stitch balancing thread tension member 205*a*, a thread guard 205*c* and a second stitch balancing thread tension member 205*b*, which are arranged on the adjustable base 205 in a predetermined pattern, and the needle thread handling area body 210 on the support casing 203 in this order. After being deflected at a thread guard 216 (see FIG. 13) on the middle thread handling area body 211, the needle thread is passed through a thread guard 217 on the thread take-up lever 207, the middle thread handling area body 211 again and then via the bobbin thread handling area body 212 and a thread guard 218 provided on a lower end of the needle bar 206 to be guided to the needle 215.

Figure 15:
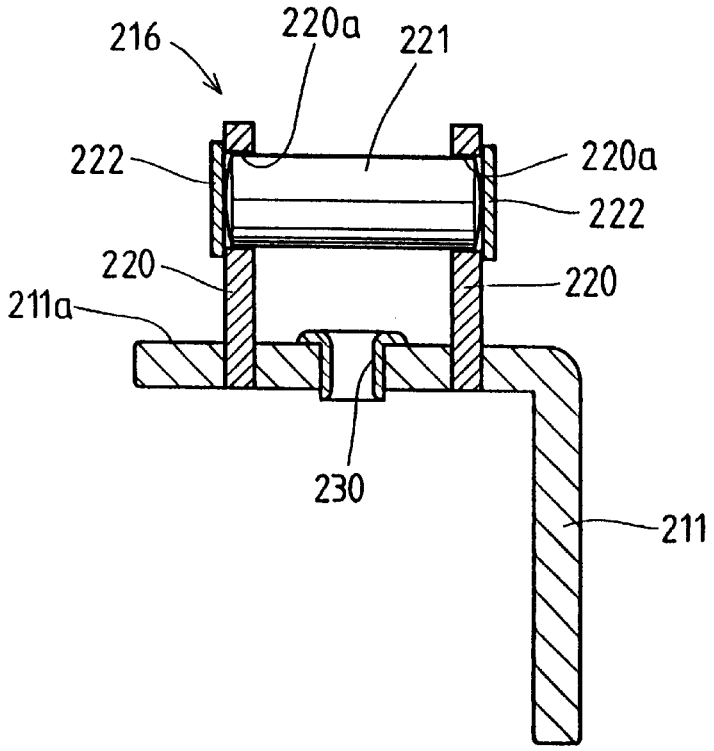
FIG. 15 is an enlarged cross-sectional view showing a thread guard on a middle thread handling area body.

A constitution of the thread guard 216 on the middle thread handling area body 211 will be described mainly with reference to FIG. 15. Two support plates 220, 220 are provided upright on a horizontal portion 211*a* of the middle thread handling area body 211 to be disposed in front of and behind a predetermined spacing from each other, the respective support plates 220, 220 being formed with support holes 220*a*. Both ends of a roller 221 are fitted into the two facing support holes 220*a*, 220*a*, so that the roller 221 is supported rotatably between the both support plates 220, 220. Stop plates 222 mounted externally on the respective support plates 220, 220 hold the roller 221 undetachably.

Figure 14:
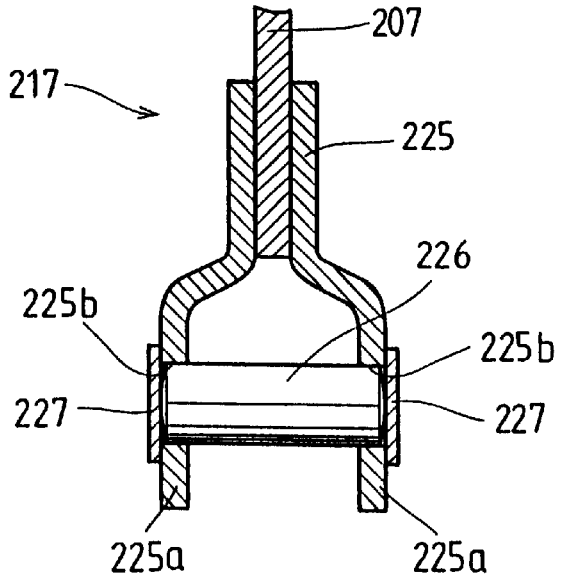
FIG. 14 is an enlarged cross-sectional view showing a thread guard on a thread take-up lever.

A constitution of the thread guard 217 on the thread take-up lever 207 will be described mainly with reference to FIG. 14. A fork-shaped bracket 225 is mounted on a tip end of the thread take-up lever 207, and support holes 225*b* are formed in bracket pieces 225*a* on both sides of the bracket. Both ends of a roller 226 are fitted into the two facing support holes 225*b*, 225*b*, so that the roller 226 is supported rotatably between the both bracket pieces 225*a*, 225*a*. Stop plates 227 mounted externally on the respective bracket pieces 225*a* also hold the roller 226 undetachably.

Figure 16:
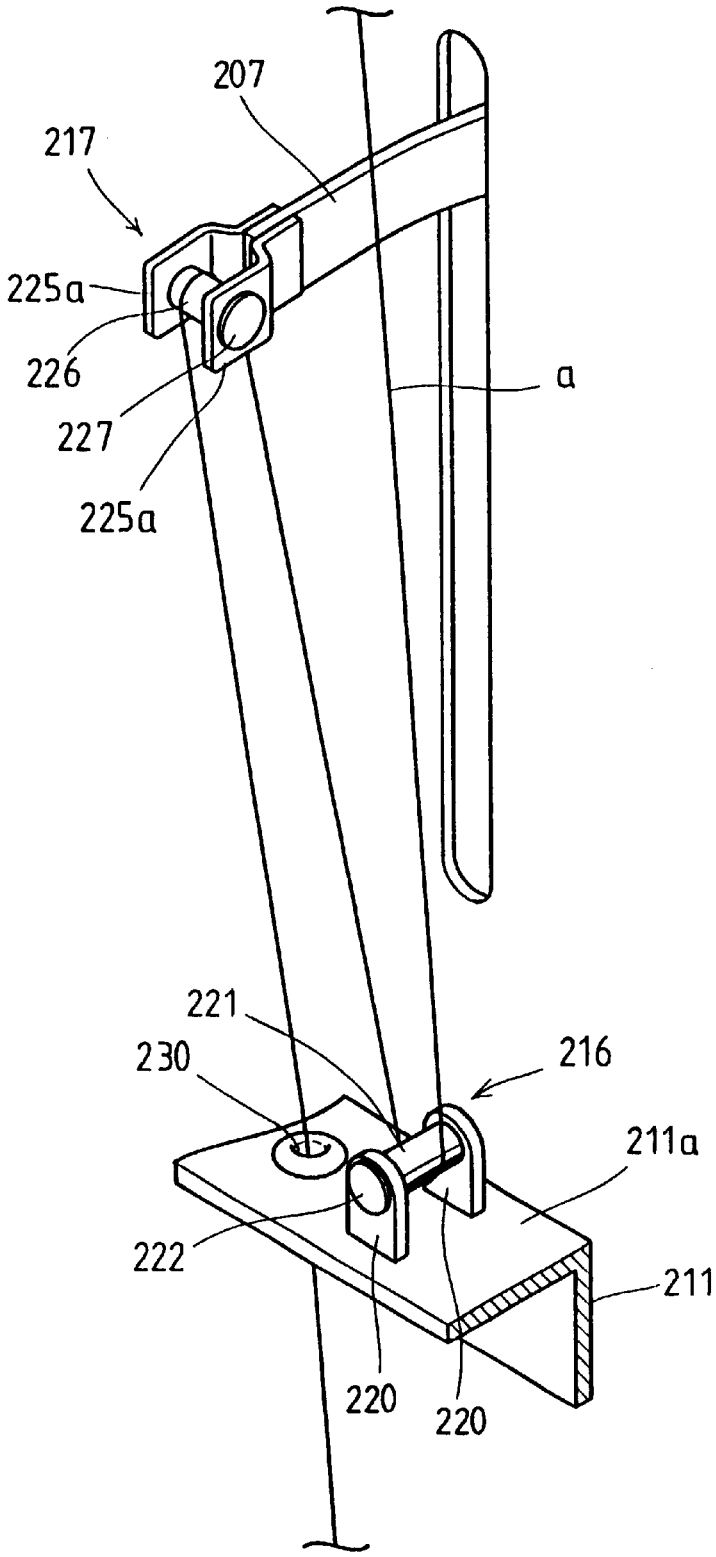
FIG. 16 is a perspective view showing a thread guard on a thread take-up lever and a middle thread handling area body.

The needle thread a having been passed through the needle thread handling area body 210 on an upper portion of the support casing 203 is passed round the roller 221 provided on the middle thread handling area body 211 to be deflected upward to be passed round the roller 226 provided on the tip end of the thread take-up lever 207 to be deflected downward, as shown in FIG. 16. Then, the needle thread a is passed through a through hole 230 formed adjacent to the roller 221 on the middle thread handling area body 211 to be directed to the bobbin thread handling area body 212.

Thus, the needle thread a is bent nearly 180 at the both rollers 221, 226, and when the needle thread a is moved onto bent portions of the respective rollers 221, 226 as the thread take-up lever 207 acts, the rollers 221, 226 rotate together. Therefore, the needle thread a generates little sliding resistance at the two bent portions, so that the bending resistance becomes exceedingly small. Accordingly, the needle thread a changes slightly in tension due to a configuration thereof with the result that it becomes possible to adjust tension of the needle thread widely and easily.

In the sewing machine according to the embodiment, rollers are applied to both the thread guards on the middle thread handling area body and on the thread take-up lever, but it is not essential to provide two rollers correspondingly and a roller may be provided only for either of the thread guards. Further, the rollers applied on the thread guards are not limited in orientation to those illustrated in the embodiment, and may be oriented in any direction provided that axes of the rollers are horizontal. With the thread take-up lever, for example, an axis of the roller may be directed forward and behind, which is sometimes favorable in terms of quality of threading operation. Further, above-mentioned rollers may be provided circumferentially at outer peripheries thereof with thread grooves, and may be in the form of a pulley.

(Third Invention)

Figure 17:
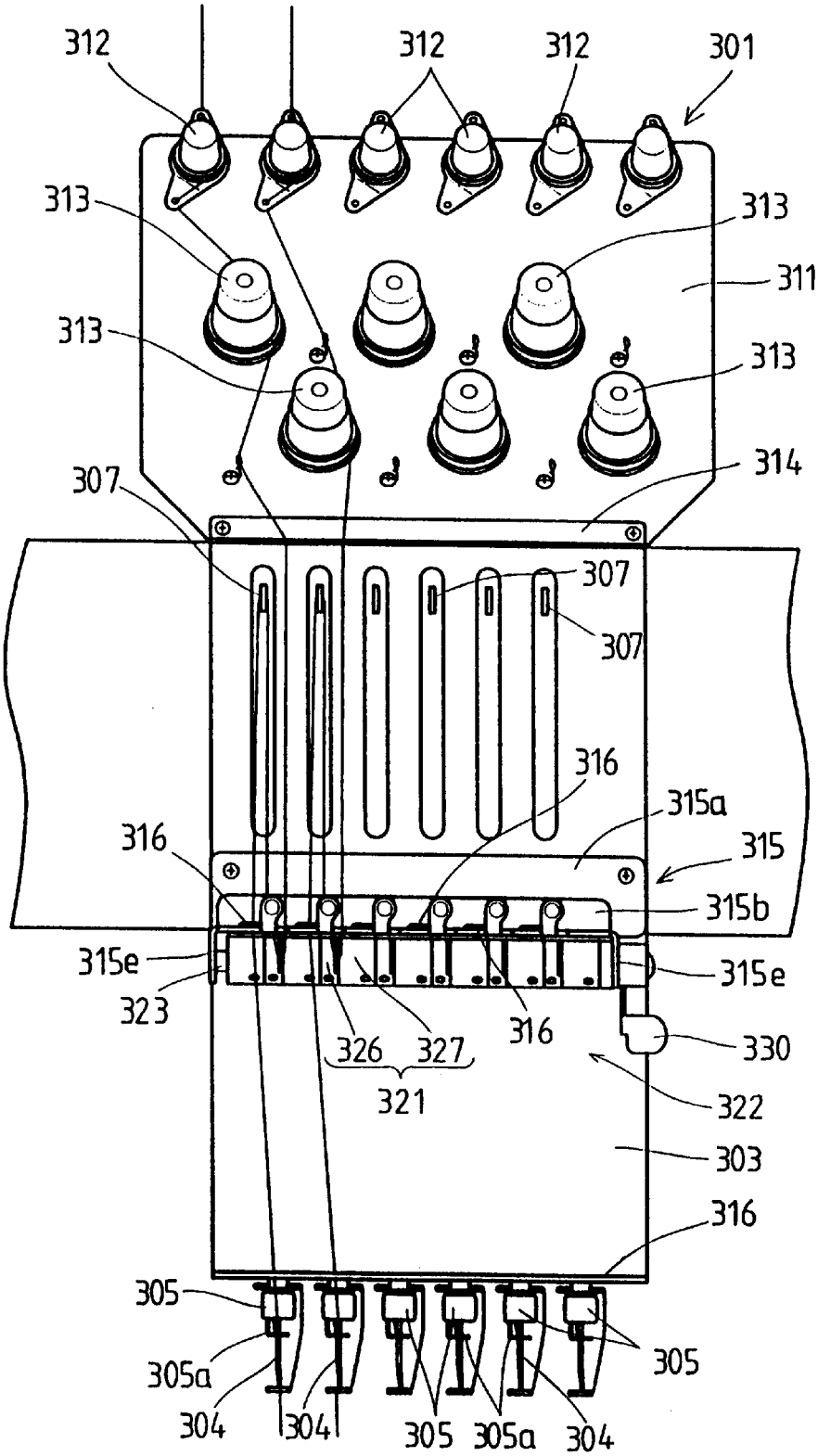
FIG. 17 is a front view showing a sewing machine head provided in a sewing machine according to a preferred embodiment of a third invention.

Subsequently, a third invention will be described. FIG. 17 shows a front view of one of a multiplicity of sewing machine heads 301 mounted on a front face of a laterally lengthy sewing machine frame (not shown). The sewing machine head 301 is constructed such that a support casing 303 is supported on a sewing machine arm 302 (see FIG. 18) fixed on the front face of the sewing machine frame to be slidable laterally. A plurality of needle bars 305 (six in the embodiment) are supported on the support casing 303 to be movable vertically, and a plurality of thread take-up levers 307 corresponding to the respective needle bars 305 are supported on the support casing to be capable of swinging. Further, the support casing 303 is connected to a drive device (not shown) to be slidingly driven, whereby one needle bar 305 and one thread take-up lever 307 are selectively interlinked with a drive mechanism (not shown) housed in the sewing machine arm 302 to be individually driven thereby.

An adjustable base 311 is fixed to a top of the support casing 303, and first stitch balancing thread tension members 312, which correspond to the respective needle bars 305 (the thread take-up levers 307), and second stitch balancing thread tension members 313 are mounted to a front face of the adjustable base 311. The respective stitch balancing thread tension members are well known, and the first stitch balancing thread tension members 312 comprise two tension discs biased by a spring to abut elastically against each other, the elasticity of the spring being adjusted to enable changing a pressing force. Also, the second stitch balancing thread tension members 313 are constructed such that a rotary disc, on an outer periphery of which a thread is wound, is pressed by a spring and the elasticity of the spring is adjusted to enable changing a rotating resistance of the rotary disc.

Figure 18:
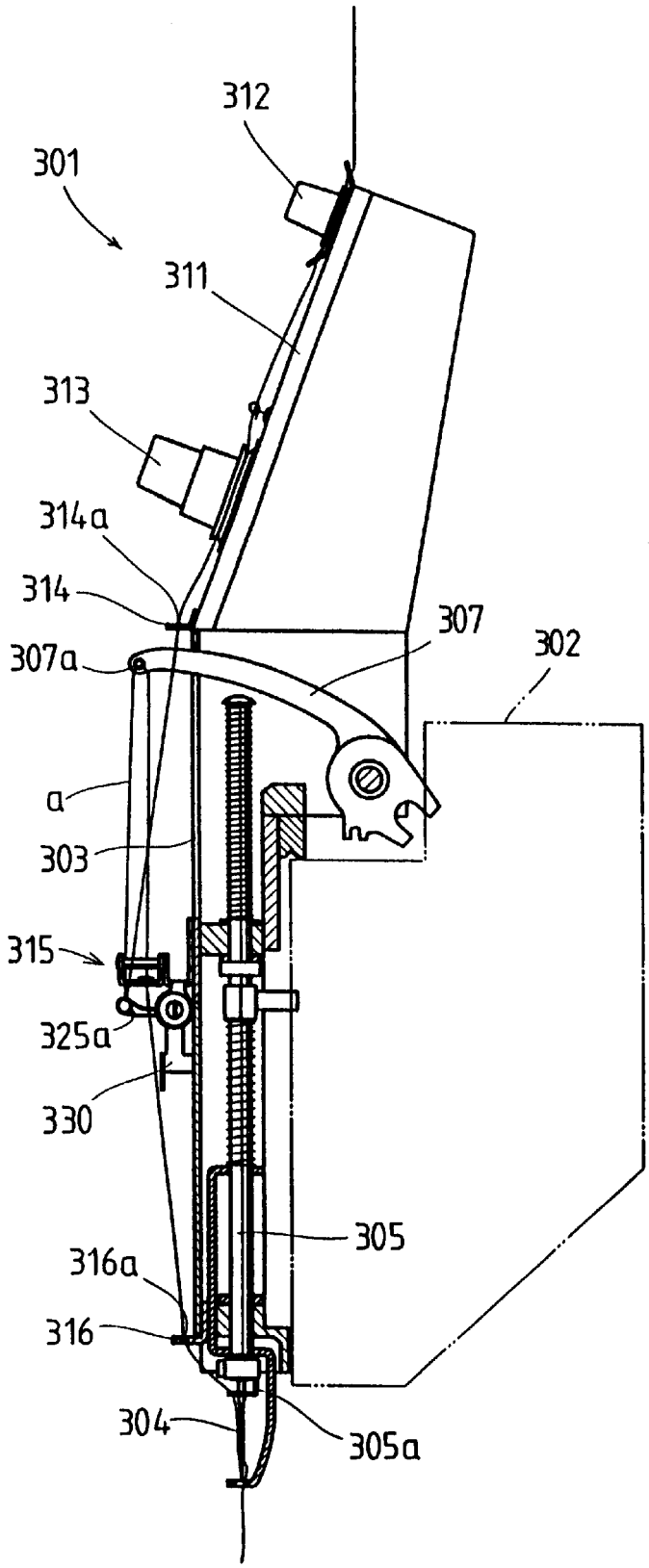
FIG. 18 is a right-side cross-sectional view showing the sewing machine head shown in FIG. 17.

As shown in FIGS. 17 and 18, mounted at upper and lower ends on a front face of the support casing 303 are a needle thread handling area 314 and a bobbin thread handling area 316, respectively, the respective thread handling areas being formed with thread holes 314*a*, 316*a*, each of which is six in number, to correspond to the respective needle bars 305. A middle thread handling area 315 functioning as a needle thread deflecting section is mounted between the needle thread handling area 314 and the bobbin thread handling area 316.

Figure 19:
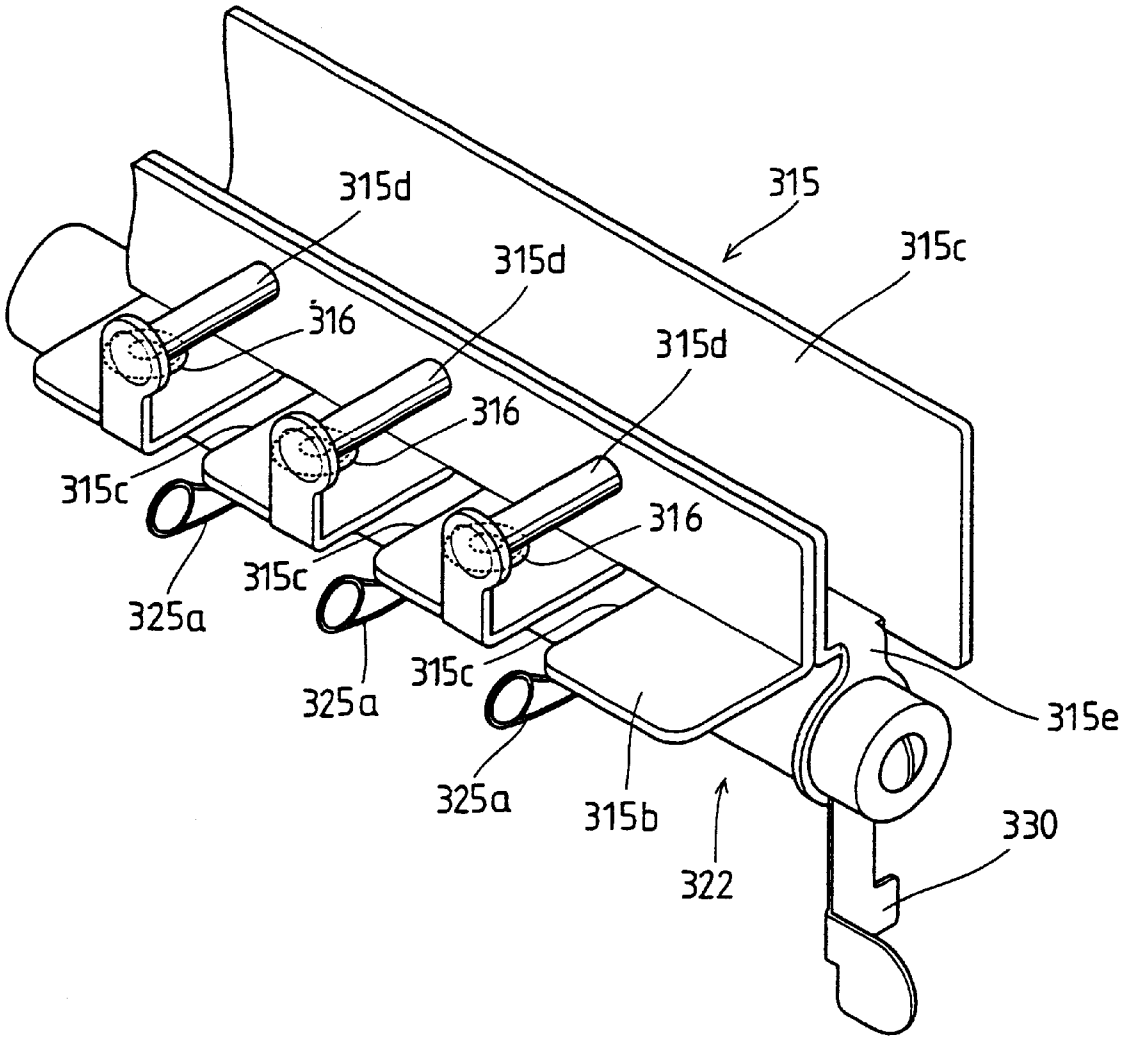
FIG. 19 is a perspective view showing a portion of a middle thread handling area provided with thread take-up members and rotating bodies.

As shown in FIG. 19, the middle thread handling area 315 is essentially comprised of a mount section 315*a* adapted to be secured to the front face of the support casing 303 and a thread handling area section 315*b* secured to a front face of the mount section 315*a*, slits 315*c* formed in the thread handling area section 315*b* to correspond to the respective thread take-up levers 307, the slits 315*c* being directed forward and behind, and rollers 315*d* mounted to the thread handling area section 315*b* to serve as rotating bodies. The respective rollers 315*d* bridge in front of and behind upright portions of the thread handling area section 315*b* to be supported horizontally in front of and behind positions above the respective slits 315*c*. Further, mounted on a horizontal portion of the thread handling area section 315*b* are thread guides 316, which are disposed on left sides of the respective slits 315*c* to be formed from a material such as ceramic or the like, and of which central holes permit threads to pass therethrough.

Figure 20:
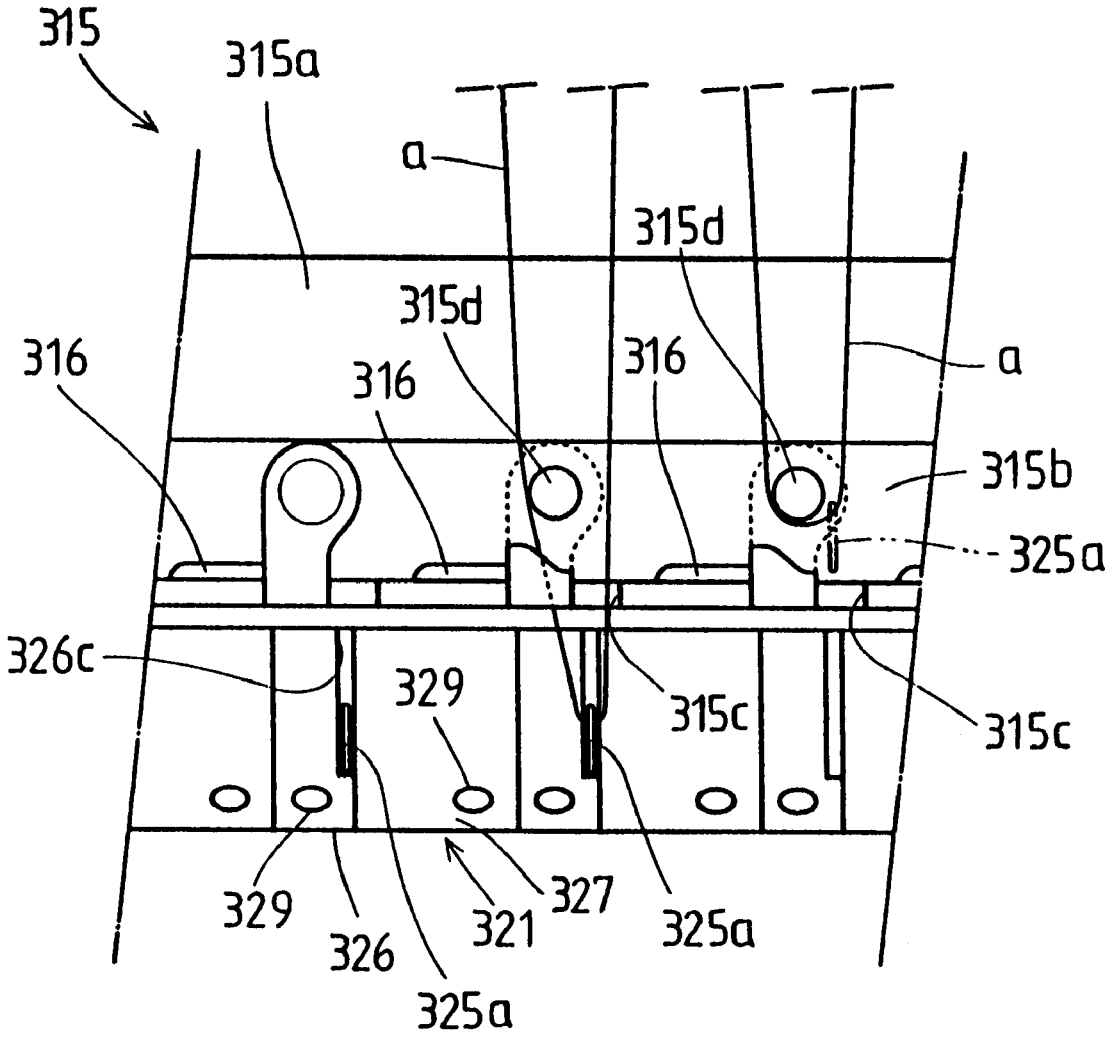
FIG. 20 is a view illustrating a portion of FIG. 19 as viewed from a front.

As shown in FIG. 20, arranged below the mount section 315*a* of the middle thread handling area 315 are thread take-up assemblies 322, which set therein thread take-up units 321 corresponding to the respective thread take-up levers 307 and having the same number (six in the embodiment) as that of the thread take-up levers 307 (the needle bars 305). The thread take-up assemblies 322 comprise a support shaft 323 rotatably supported between support plates 315*e*, 315*e* suspended from both ends of the mount section 315*a* on the middle thread handling area 315, and the respective thread take-up units 321 mounted on the support shaft 323.

Figure 21:
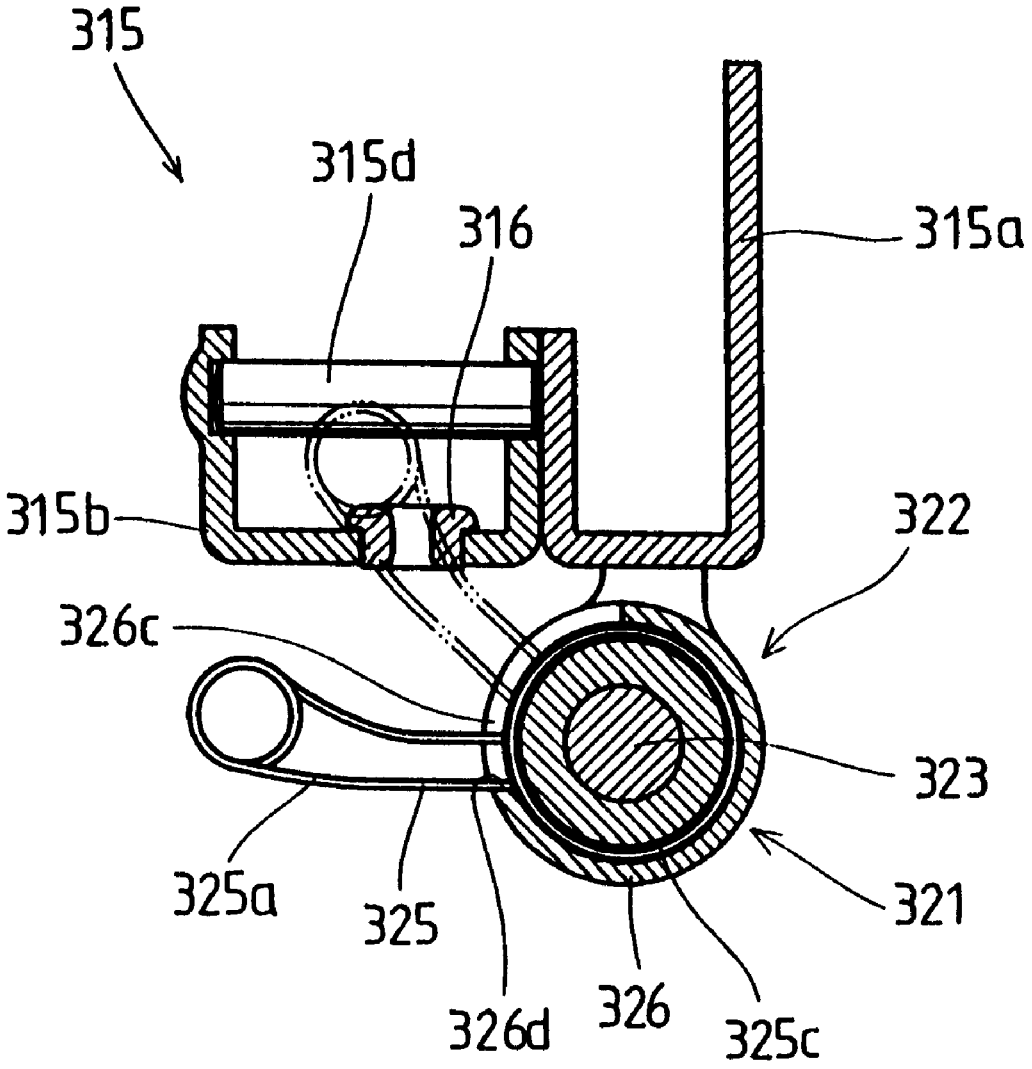
FIG. 21 is a longitudinal, cross-sectional view showing a middle thread handling area provided with a thread take-up member and a rotating body.

As shown in FIGS. 20 and 21, the respective thread take-up units 321 comprise a thread take-up member 325, which comprises a spirally wound spring steel wire, a stopper member 326 and a spring tension adjusting member 327. The thread take-up member 325 comprises an arm portion 325*a* formed at one end of a spirally wound portion 325*c* in closed loop and extending radially, and a latch portion (not shown) formed at the other end of the spirally wound portion 325*c* to project in an axial direction of the portion 325*c*. Further, the spring tension adjusting member 327 comprises a central hole adapted to fit rotatably onto the support shaft 323, and a mount hole, into which the spirally wound portion 325*c* of the thread take-up member 325 is loosely fitted, and is formed with a latch hole (not shown), into which the latch portion of the thread take-up member 325 is fitted for latching. Also, the stopper member 326 comprises a central hole adapted to fit rotatably onto the support shaft 323, and is formed with a slit 326*c*, which permits the arm portion 325*a* on the thread take-up member 325 to move vertically between the slit and the spring tension adjusting member 327.

The stopper member 326 and the spring tension adjusting member 327 are secured to the support shaft 323 by fastening a screw 329 threaded into a threaded hole formed on a peripheral side surface of the spring tension adjusting member 327. The spring tension of the thread take-up member 325 can be set by adjusting an angle, by which the spring tension adjusting member 327 is further rotated after the spring tension adjusting member 327 is rotated in a counterclockwise direction in FIG. 21 to cause a root portion of the arm portion 325*a* on the thread take-up member 325 to abut against a stopper portion 326*d* formed on an end surface of the slit 326*c* on the stopper member 326.

Further, the arm portions 325*a* on the thread take-up members 325 in the respective thread take-up units 321 are set correspondingly immediately below the respective slits 315*c* formed in the thread handling area section 315*b*, as shown in FIG. 20, by mounting the respective thread take-up units 321 closely on the support shaft 323. Also, the support shaft 323 on the thread take-up assembly 322 is rotatable as described above, and a lever 330 is secured to an end of the support shaft extending from the righthand support plate 315*e*. The support shaft 323 can be rotated by grasping the lever 330 with hand and raising and levelling the same.

Operation of the sewing machine according to the embodiment will be described hereinafter. A length of needle thread a unwound from a thread bobbin (not shown) set at a position upwardly of and backwardly of the sewing machine heads 301 is fed to an upper portion of the adjustable base 311 via a predetermined thread guide. The needle thread a is passed through the first stitch balancing thread tension member 312 and the second stitch balancing thread tension member 313 on the adjustable base 311, the thread hole 314*a* in the needle thread handling area 314, the middle thread handling area 315, a thread hole 307*a* in the thread take-up lever 307 and the thread holes 316*a* in the bobbin thread handling area 316 in this order, and then is passed through the eye of a needle 304 via a thread guard 305*a* on the needle bar 305.

To pass the thread through the middle thread handling area 315, the support shaft 323 is rotated in a clockwise direction by pulling the lever 330 toward an operator, and then tip ends of the arm portions 325*a* on the thread take-up members 325 are made to rise laterally of the rollers 315*d* as shown with imaginary lines in FIG. 21. Thereafter, the needle thread a is passed to the tip ends of the arm portions 325*a*. After completion of the threading operation in this area, the lever 330 is returned to the original position as shown with solid lines in FIG. 21, and hence the arm portions 325*a* on the respective thread take-up members 325 are returned to their normal positions. In this manner, the one-touch operation of the lever 330 enables readily and rapidly performing the threading operation in an area on the middle thread handling area 315 and manipulation of the lever 330 enables making the arm portions 325*a* on the respective thread take-up members 325 all together in positions, at which threading is made possible. Therefore, the arrangement is especially effective in the case of, for example, performing threading on the six needle bars 305 initially.

In operation of the sewing machine, every time the needle bar 305 selected reciprocates, the arm portion 325*a* on the thread take-up member 325 actuates to reciprocate between positions shown with imaginary lines and solid lines in FIG. 21. At this time, a bent portion of the needle thread a existing between the thread take-up lever 307 and the arm portion 325*a* is defined only by the roller 315*d*, which in turn is rotatable upon contact with the needle thread a, and so the bending resistance on the needle thread becomes exceedingly small. Accordingly, the arm portion 325*a* on the thread take-up member 325 sharply reacts on that change in tension of the needle thread a, which change generates downstream of the thread take-up lever 307. Therefore, unlike the prior art apparatuses, generation of thread breakage caused by late reaction of a thread take-up member can be effectively avoided. Further, in the embodiment, operation of the lever 330 to suitably change a position of the arm portions 325*a* in free condition can vary strokes of the arm portions 325*a* on the respective thread take-up members 325 all together, so that a countermeasure in one-touch operation can be taken depending upon a kind of thread, stitch performance and a desired stitching.

Further, as described above, the spring tension of each of the thread take-up members 325 can be individually adjusted by each of the thread take-up units 321, so that different adjustment of thread take-up levers can be made by each of the needle bars to take a suitable countermeasure depending upon the kind of needle thread used. In addition, with the respective thread take-up units 321, thread breakage of the needle thread a or the like can be detected by providing an electrode on the stopper portion 326*d* for the arm portion 325*a* on the thread take-up member 325 and electrically detecting a condition of the electrode contacting with the arm portion 325*a*.

Figure 22:
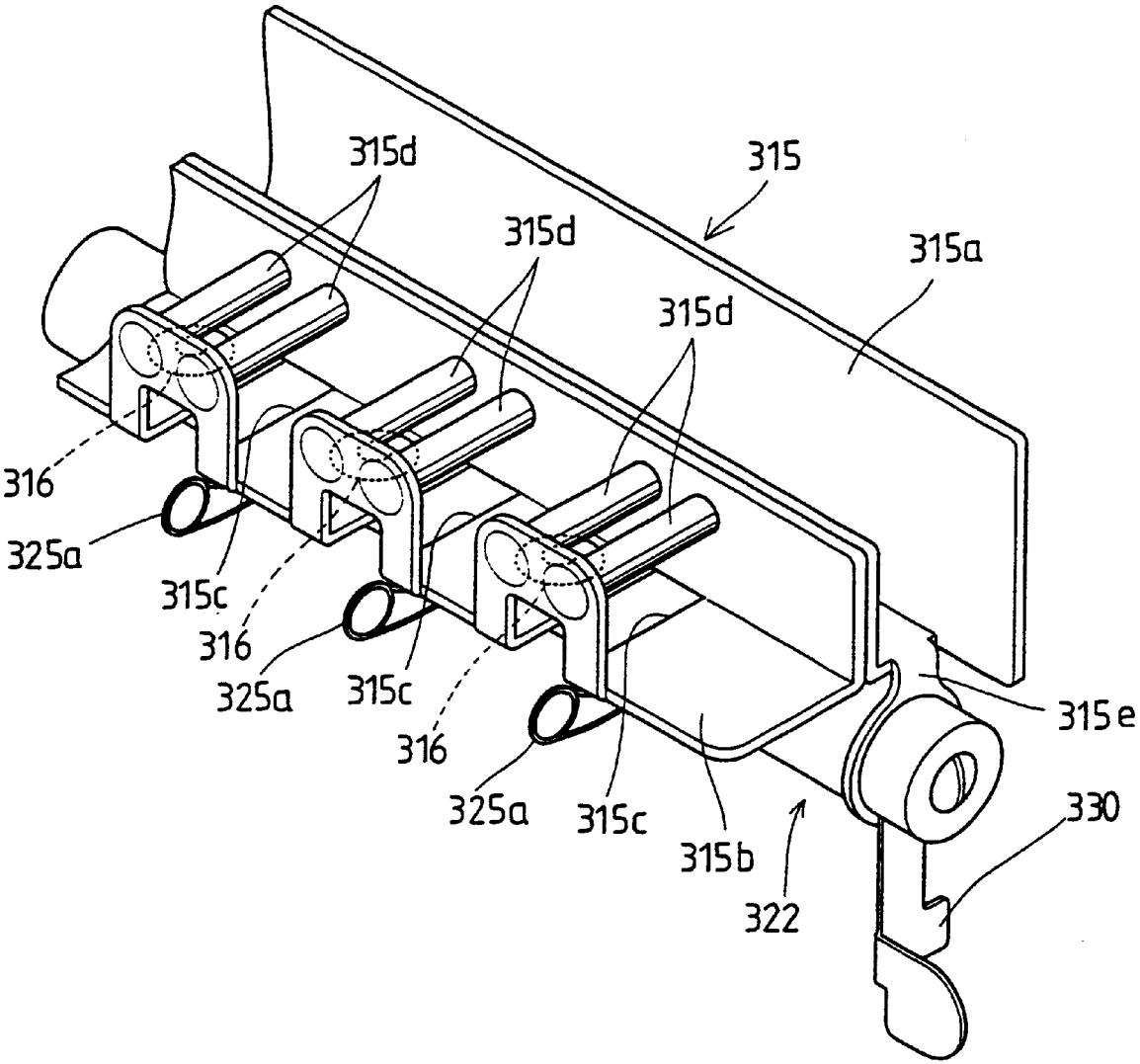
FIG. 22 is a perspective view showing a middle thread handling area provided with thread take-up members and rotating bodies, according to a second embodiment.
Figure 23:
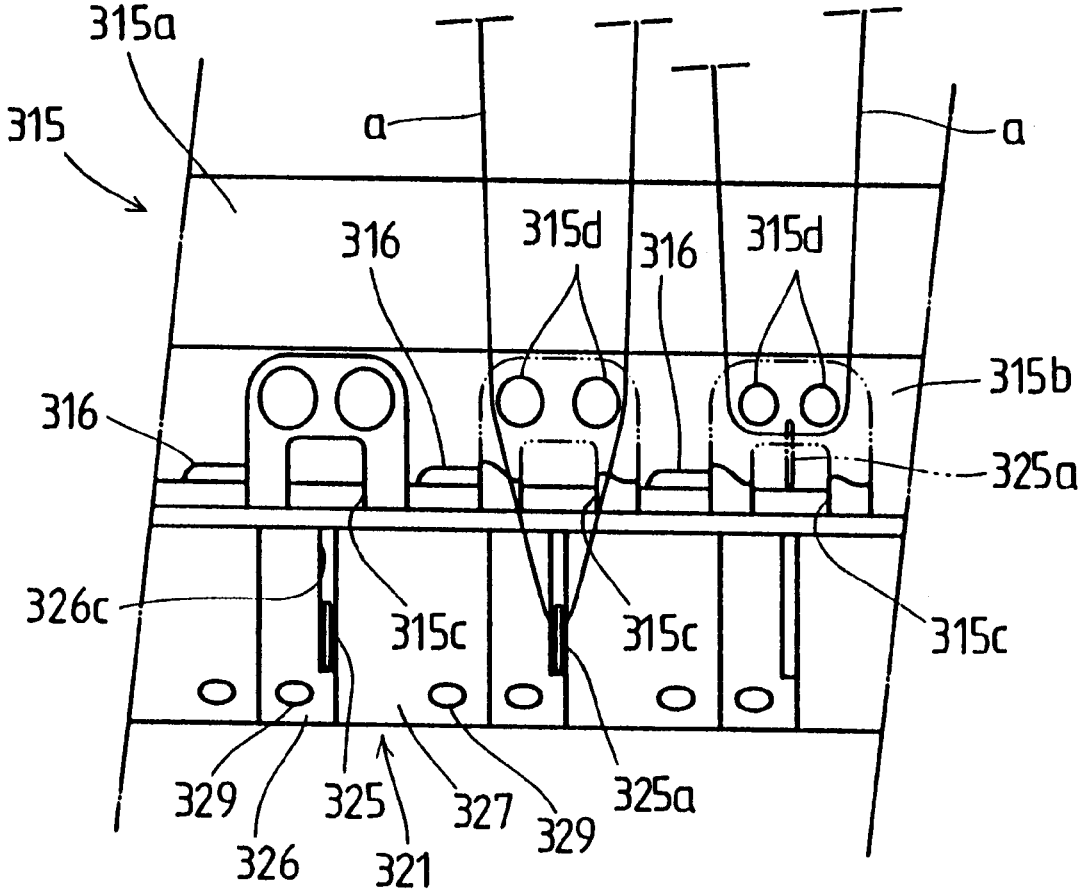
FIG. 23 is a view illustrating a portion of FIG. 22 as viewed from a front.

Subsequently, a second embodiment of the third invention will be described with reference to FIGS. 22 and 23. The second embodiment is different from the above described first embodiment in that rollers 315*d* are dually provided as rotating bodies. More specifically, the two rollers 315*d*, 315*d* are supported in parallel to each other above the respective slits 315*d* formed in the thread handling area section 315*b* on the middle thread handling area 315 to be separated a predetermined spacing from each other. The needle thread a is made to pass along the two rollers 315*d*, 315*d*, and an operation of setting the needle thread a is the same in the first embodiment. In the present embodiment, there is an advantage that the arm portion 325*a* acts stably without swinging right and left because the tension of the thread exerts on the arm portion 325*a* uniformly right and left when the arm portion 325*a* on the thread take-up member 325 reciprocates between positions shown with solid lines and imaginary lines in FIG. 23 as the needle thread a behaves.

What is claimed is:

1. In a multineedle embroidering sewing machine including at least one sewing machine head provided with a plurality of needle bars and a plurality of thread take-up levers corresponding to the needle bars, the multineedle embroidering sewing machine further comprising needle thread deflecting sections, respectively, arranged directly upstream of the respective thread take-up levers existing in needle thread paths, and thread take-up springs closely provided correspondingly on the respective needle thread deflecting sections.

2. The sewing machine according to claim 1, wherein the respective thread take-up member can be changed in position all together.

3. A multineedle embroidering sewing machine including; at least one sewing machine head provided with a plurality of needle bars and a plurality of thread take-up levers corresponding to the needle bars, needle thread deflecting sections, respectively, arranged upstream of the respective thread take-up levers existing in needle thread paths, and thread take-up members provided correspondingly on the respective needle thread deflecting sections, wherein the needle thread deflecting sections comprise two thread handling area bodies, respectively, formed with thread holes, and a gap between the two head handling area bodies correspondingly bridges a slit formed in a middle thread handling area.

4. A multineedle embroidering sewing machine including at least one sewing machine head provided with a plurality of needle bars and a plurality of thread take-up levers corresponding to the needle bars needle thread deflecting sections, respectively, arranged upstream of the respective thread take-up levers existing in needle thread paths, and thread take-up members provided correspondingly on the respective needle thread deflecting sections, wherein the needle thread deflecting sections comprise two thread handling area bodies, respectively, formed with thread holes, and a gap between the two tread handling area bodies correspondingly bridges a slit formed in a middle thread handling area, and wherein a thread take-up assembly is arranged below the middle thread handling area, this thread take-up assembly comprises a support shaft supported between facing support plates to be rotatable and slidable in an axial direction, and thread take-up units are provided on the support shaft to be the same number as the thread take-up levers, and further said thread take-up units comprise the thread take-up member formed from a spiral spring, a stopper member, and a spring tension adjusting member.

5. A lock stitch type sewing machine including at least one sewing machine head provided with a plurality of needle bars and a plurality of thread take-up levers adapted to take up needle threads, comprising needle thread deflecting sections, respectively, arranged directly upstream of the respective thread take-up levers existing in needle thread paths, and thread take-up springs closely provided correspondingly on the respective needle thread deflecting sections.

6. The lock switch type sewing machine according to claim 5 wherein rollers are provided on a thread handling area that corresponds to each of said needle bars.

7. The lock switch type sewing machine according to claim 5, wherein a thread handling area that corresponds to each needle bar is formed by a pair of rollers which are horizontally provided with a space in between so that a thread passing along said two rollers passes along the thread take-up springs.

* * * * *